US005342816A

United States Patent [19]

Lindholm et al.

[11] Patent Number: 5,342,816

[45] Date of Patent: Aug. 30, 1994

[54] IMAGING MEDIUM WITH BUBBLE-SUPPRESSANT LAYER

[75] Inventors: Edward P. Lindholm, Brookline; Stephen J. Telfer, Arlington; Michael J. Zuraw, Arlington, all of Mass.; Bernard L. Hirschbein, San Francisco, Calif.

[73] Assignee: Polaroid Corporation, Cambridge, Mass.

[21] Appl. No.: 108,893

[22] Filed: Aug. 18, 1993

Related U.S. Application Data

[63] Continuation of Ser. No. 695,641, May 6, 1991, abandoned.

[51] Int. Cl.[5] ..... B41M 5/40

[52] U.S. Cl. ..... 503/226; 430/200; 503/200; 503/202

[58] Field of Search ..... 430/200; 503/200, 204, 503/226, 202

[56] References Cited

U.S. PATENT DOCUMENTS

| | | | |
|---|---|---|---|
| 4,508,811 | 4/1985 | Gravesteijn et al. | 430/270 |
| 4,551,738 | 11/1985 | Maruta et al. | 503/200 |
| 4,602,263 | 7/1986 | Borrer et al. | 346/201 |
| 4,682,194 | 7/1987 | Usami et al. | 503/215 |
| 4,713,310 | 12/1987 | Horie | 430/109 |
| 4,720,449 | 1/1988 | Borrer et al. | 430/338 |
| 4,720,450 | 1/1988 | Ellis | 430/339 |
| 4,727,054 | 2/1988 | Yuyuma et al. | 503/200 |
| 4,745,046 | 5/1988 | Borrer et al. | 430/332 |
| 4,826,976 | 5/1989 | Borrer et al. | 544/58.4 |
| 4,910,184 | 3/1990 | Ishida et al. | 503/207 |
| 4,927,803 | 5/1990 | Bailey et al. | 503/227 |
| 4,960,901 | 10/1990 | Borrer et al. | 548/207 |
| 4,977,136 | 12/1990 | Fujiwara et al. | 503/227 |
| 5,017,421 | 5/1991 | Hotta et al. | 503/226 |

FOREIGN PATENT DOCUMENTS

| | | | |
|---|---|---|---|
| 187449 | 7/1986 | European Pat. Off. | 503/200 |
| 162088 | 3/1926 | Japan | 503/200 |
| 128347 | 10/1979 | Japan | 503/200 |
| WO85/04842 | 11/1985 | PCT Int'l Appl. | 503/200 |
| 2094496 | 9/1982 | United Kingdom | 503/200 |

OTHER PUBLICATIONS

Patent Abstracts of Japan, 14(212), Abstract 2-47089, Published May 2, 1990.

Patent Abstracts of Japan, 8(158) Abstract 59-52692, Published Jul. 21, 1984.

*Primary Examiner*—Pamela R. Schwartz

*Attorney, Agent, or Firm*—David J. Cole

[57] ABSTRACT

An imaging medium capable of being imaged to form a transparency comprises a substantially transparent support having a thickness of at least about 20 μm, a color-forming layer superposed on the support and comprising a color-forming composition adapted to undergo a change of color upon increase in the temperature of the color-forming layer above a color-forming temperature for a color-forming time; and a bubble-suppressant layer superposed on the color-forming layer and having a thickness of at least about 10 μm. Upon imagewise increase in the temperature of the color-forming layer above the color-forming temperature for the color-forming time, in heated regions the color-forming layer undergoes its change of color but remains essentially free from bubbles, thereby providing an image in which the colored regions are not blackened when viewed in transmission.

25 Claims, 1 Drawing Sheet

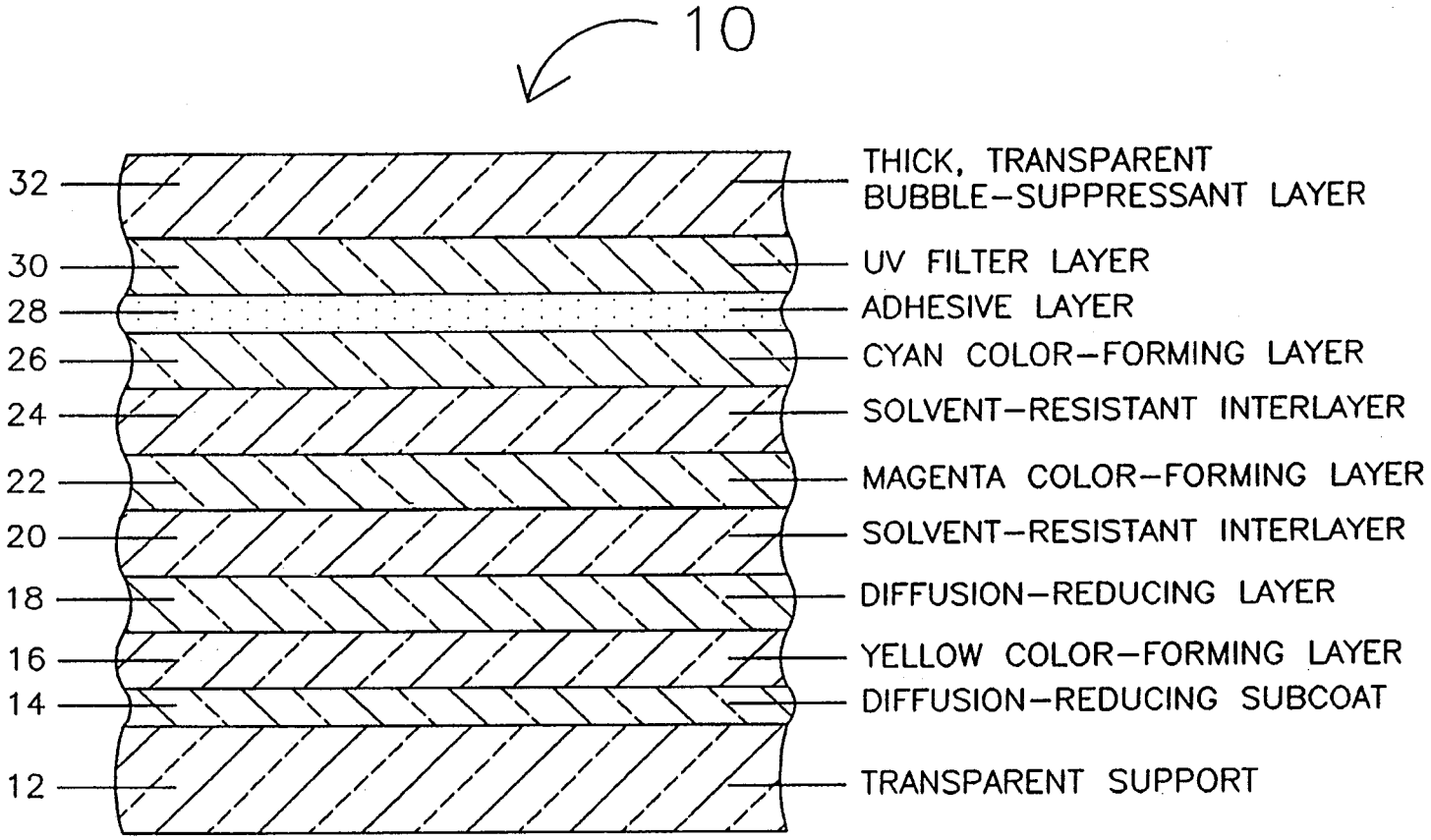
10
THICK, TRANSPARENT BUBBLE-SUPPRESSANT LAYER
UV FILTER LAYER
ADHESIVE LAYER
CYAN COLOR-FORMING LAYER
SOLVENT-RESISTANT INTERLAYER
MAGENTA COLOR-FORMING LAYER
SOLVENT-RESISTANT INTERLAYER
DIFFUSION-REDUCING LAYER
YELLOW COLOR-FORMING LAYER
DIFFUSION-REDUCING SUBCOAT
TRANSPARENT SUPPORT
32
30
28
26
24
22
20
18
16
14
12

IMAGING MEDIUM WITH BUBBLE-SUPPRESSANT LAYER

This application is a continuation of application Ser. No. 07/695,641, filed May 6, 1991 now abandoned.

REFERENCES TO RELATED APPLICATIONS

The copending application and patents Ser. No. U.S. Pat. No. 5,153,169 describes and claims imaging media having a color-forming layer containing a hindered amine light stabilizer or a nitrone as a color stabilizer, as used in the imaging medium shown in the accompanying drawing.

The copending application Ser. No. 07/696,196, filed May 6, 1991 by Edward P. Lindholm et al. and assigned to the same assignee as the present application, describes and claims imaging media having a color-forming layer with a high glass transition temperature, and at least one diffusion-reducing layer, as shown in the accompanying drawing.

U.S. Pat. No. 5,231,190 describes and claims the infrared dye of formula:

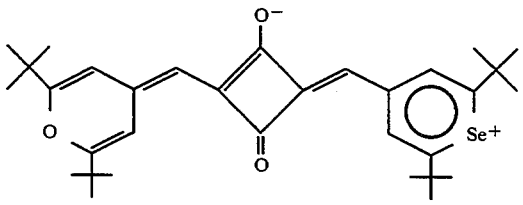

used in the imaging medium of the present invention shown in the accompanying drawing.

U.S. Pat. No. 5,236,884 entitled "Thermal Imaging Method", by Roger A. Boggs et al., of even date herewith and assigned to the same U.S. Pat. No. 5,236,884 describes and claims leuco dyes which can be used in the imaging medium of the present invention.

U.S. Pat. No. 5,192,645 by Roger A. Boggs et al., and assigned to the same assignee as the present application, describes and claims the yellow leuco dye used in the imaging medium of the present invention shown in the accompanying drawing.

U.S. Pat. No. 5,243,052 describes and claims quinophthalone leuco dyes which can be used in the imaging medium of the present invention.

The disclosures of all the aforementioned patents and copending applications are herein incorporated by reference.

BACKGROUND OF THE INVENTION

This invention relates to an imaging medium with a bubble-suppressant layer, and to an imaging process using such an imaging medium.

Imaging media are known which have at least one color-forming layer comprising a color-forming composition adapted to undergo a change of color (from colorless to colored, from colored to colorless, or from one color to another) upon increase in the temperature of the color-forming layer above a color-forming temperature for a color-forming time. The color change in such media need not be supplied by applying heat directly to the medium; the color-forming composition may comprise a color-forming compound which undergoes a change of color upon heating above a color-forming temperature, and an absorber capable of absorbing actinic radiation and thereby generating heat in the color-forming layer. When such a medium is exposed to appropriate actinic radiation, this radiation is absorbed by the absorber, thereby heating the color-forming compound and causing it to undergo its color change. Many such thermal imaging media have the advantage over conventional silver halide media of not requiring a post-exposure developing step. Such thermal imaging media also have the advantage that they are essentially insensitive to visible light, so that they can be handled under normal lighting conditions.

For example U.S. Pat. Nos. 4,602,263 and 4,826,976 both describe thermal imaging systems for optical recording and particularly for forming color images. These thermal imaging systems rely upon the irreversible unimolecular fragmentation of one or more thermally unstable carbamate moieties of an organic compound to effect a visually discernible color shift. U.S. Pat. No. 4,720,449 describes a similar imaging system in which the color-developing component is a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to the meso carbon atom and the nitrogen atom being bound to a group with a masked acyl substituent that undergoes fragmentation upon heating to liberate the acyl group for effecting intramolecular acylation of the nitrogen atom to form a new group in the ortho position that cannot bond to the meso carbon atom, whereby the di- or triarylmethane compound is rendered colored. Other thermal imaging systems using di- or triarylmethane compounds are described in U.S. Pat. Nos. 4,720,450 and 4,960,901, while U.S. Pat. No. 4,745,046 describes a thermal imaging system using as color-forming co-reactants a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting the di- or triarylmethane compound undergoes a bimolecular nucleophilic substitution reaction with the nucleophilic moiety to form a colored, ring-opened di- or triarylmethane compound. Finally, the aforementioned U.S. Pat. No. 5,192,645 describes a thermal imaging system in which the color-forming component is a colorless precursor of a preformed image dye substituted with (a) at least one thermally removable protecting group that undergoes fragmentation from the precursor upon heating and (b) at least one leaving group that is irreversibly eliminated from the precursor upon heating, provided that neither the protecting group nor the leaving group is hydrogen, said protecting and leaving groups maintaining the precursor in its colorless form until heat is applied to effect removal of the protecting and leaving groups, whereby the colorless precursor is converted to an image dye.

The aforementioned patents describe a preferred form of imaging medium for forming multicolor images; in this preferred imaging medium, three separate color-forming layers, capable of forming yellow, cyan and magenta dyes respectively, are superposed on top of one another. Each of the three color-forming layers has an infra-red absorber associated therewith, these absorbers absorbing at differing wavelengths, for example 760, 820 and 880 nm. This medium is imagewise exposed simultaneously to three lasers having wavelengths of 760, 820 and 880 nm. (In the present state of technology, solid state diode lasers emitting at about 760 to 1000 nm provide the highest output per unit cost. Since most of the color-forming materials (also hereinafter referred to as "leuco dyes", with the understanding that the leuco dye may comprise more than one compound) described in the aforementioned patents do not have high extinction coefficients within this wavelength range, it is necessary to include the infra-red absorbers with the leuco dyes in order to ensure efficient absorption of the laser radiation and hence efficient heating of the leuco dye.) The resultant imagewise heating of the color-forming layers causes the leuco dyes to undergo color changes in the exposed areas, thereby producing a multicolored image, which needs no development.

This preferred type of imaging medium is capable of very high resolution images; for example, the medium can readily be used to produce a 2000 line 35 mm slide. However, it has now been found that, when this preferred type of imaging medium is used to produce a slide or other transparency, strongly colored areas of the image which appear to have the correct color when viewed in reflection against a white background appear essentially black when the image is projected (i.e., seen in transmission). This discrepancy between the appearance of the image in reflection and transmission will hereinafter be referred to as "blackening" of the image. The discrepancy can be dramatic; the present inventors have produced images with areas which appear chrome yellow in reflection but black in transmission.

It has now been found that this blackening of the image is due to the formation of bubbles in the color-forming layer(s) and can be reduced or eliminated by providing the imaging medium with a bubble-suppressant layer of appropriate thickness. (The term "bubbles" is used herein to refer to bubbles, voids, cracks, tears and similar artifacts which are present in the final image and which scatter visible light.)

SUMMARY OF THE INVENTION

Accordingly, this invention provides an imaging medium capable of being imaged to form a transparency and comprising:

a substantially transparent support having a thickness of at least about 20 μm;

a color-forming layer superposed on the support and comprising a color-forming composition adapted to undergo a change of color upon increase in the temperature of the color-forming layer above a color-forming temperature for a color-forming time; and a bubble-suppressant layer superposed on the color-forming layer and having a thickness of at least about 10 μm, such that, upon imagewise increase in the temperature of the color-forming layer above the color-forming temperature for the color-forming time, in heated regions the color-forming layer undergoes its change of color but remains essentially free from bubbles.

This invention also provides a process for forming an image, the process comprising:

providing an imaging medium comprising a substantially transparent support having a thickness of at least about 20 μm; a color-forming layer superposed on the support and comprising a color-forming composition adapted to undergo a change of color upon increase in the temperature of the color-forming layer above a color-forming temperature for a color-forming time; and a bubble-suppressant layer superposed on the color-forming layer and having a thickness of at least about 10 μm,; and imagewise heating the color-forming layer above the color-forming temperature for the color-forming time, thereby causing the color-forming composition to undergo the change of color in heated regions and thereby form an image, the color-forming layer being essentially free from bubbles after the imagewise heating.

BRIEF DESCRIPTION OF THE DRAWING

The accompanying drawing shows a schematic cross-section through a preferred imaging medium of the present invention.

DETAILED DESCRIPTION OF THE INVENTION

As already mentioned, the imaging medium of the present invention comprises a substantially transparent support having a thickness of at least about 20 μm, a color-forming layer superposed on the support and comprising a color-forming composition which undergoes a change of color upon increase in the temperature of the color-forming layer above a color-forming temperature for a color-forming time, and a bubble-suppressant layer superposed on the color-forming layer and having a thickness of at least about 10 μm, and such that, upon imagewise increase in the temperature of the color-forming layer above the color-forming temperature, in heated regions the color-forming layer undergoes its change of color but remains essentially free from bubbles.

As with the imaging media described in the aforementioned U.S. patents, in the imaging medium of the present invention the color-forming composition desirably comprises a color-forming compound which undergoes a change of color upon heating above a color-forming temperature for a color-forming time, and an absorber capable of absorbing actinic radiation and thereby generating heat in the color-forming layer. This type of imaging medium can be imaged by actinic radiation rather than by direct heating, and a high resolution image is more easily achieved using actinic radiation, for example a focussed laser.

The bubble-suppressant layer used in the imaging medium of the present invention serves, in conjunction with the support, to reduce or eliminate the formation of bubbles during imaging. Bubble suppression requires layers of appropriate thickness on both sides of the color-forming layer or layers but since imaging media normally incorporate a support on to which the color-forming layers are coated (this support normally having a thickness in the range of about 25 to about 200 μm), the support acts as one bubble-suppressant layer, and it is therefore only necessary to provide a bubble-suppressant layer on the opposed side of the color-forming layer(s) from the support in order to achieve bubble suppression.

As already mentioned, bubbles in the exposed medium cause scattering of light passing through the medium, and thus result in blackening of the image. It has been found empirically that a bubble-suppressant layer at least about 10 μm thick is required for efficient suppression of bubbles. When a multimode semiconductor diode laser is employed for imaging, the minimum thickness of the bubble-suppressant layer required varies somewhat with the near-field uniformity of the laser, with lasers having poor near-field uniformity requiring thicker bubble-suppressant layers than lasers with better near-field uniformity. Since the medium will normally be imaged through the bubble-suppressant layer (although it may alternatively be imaged through the support), an excessively thick bubble-suppressant layer is undesirable since it may cause difficulties in focussing actinic radiation on the color-forming layer or layers. Conveniently, the bubble-suppressant layer has a thickness in the range of about 15 μm to about 100 μm; preferably the bubble-suppressant layer has a thickness of at least about 20 μm. This range of thickness is considerably greater than that required for prevention of abrasion. It is also desirable that the bubble-suppressant layer be non-birefringent, since, if the medium is imaged through the bubble-suppressant layer, a birefringent bubble-suppressant layer may cause difficulties in focussing the laser at the proper level within the medium.

The bubble-suppressant layer used in the present imaging medium may comprise one or more sub-layers, provided the total thickness of the bubble-suppressant layer is sufficent to provide effective bubble suppression as discussed above. In particular, when the bubble-suppressant layer is formed by coating (as discussed in more detail below), it may be convenient to form a thick bubble-suppressant layer by depositing a plurality of sub-layers in a plurality of coating steps.

A wide variety of materials may be used to form the bubble-suppressant layer, provided that the material chosen is sufficiently transparent that it does not interfere with the imaging process or raise excessively the $D_{min}$ of the final image. One preferred material for the bubble-suppressant layer is a polyester, desirably poly(ethylene terephthalate). Polyesters are effective in suppressing bubbles and also provide protection for the color-forming layer(s) of the medium during handling and storage. Commercially available polyester films having a thickness in the range of 1.5 to 2 mil (38 to 51 μm) can conveniently be used to form the bubble-suppressant layer.

The method by which the bubble-suppressant layer is formed is not critical, provided that it adheres to the other layers of the imaging medium sufficiently to suppress bubble formation. Thus, the bubble-suppressant layer may be laminated to the remaining layers of the imaging medium or may be formed by coating on to the remaining layers. In both cases, it may be desirable to include an adhesive layer to increase adhesion of the bubble-suppressant layer to the remaining layers.

The support should be sufficiently thick as to permit easy handling of the imaging medium (as well as helping to suppress bubbles), and may be any material that substantially retains its dimensional stability during imaging. Desirably, the support has a thickness of at least about 50 μm. The support must be sufficiently transparent that it does not raise excessively the $D_{min}$ of the final image. If it is desired to image through the support, the support must also be sufficiently transparent that it does not interfere with the imaging process, and is preferably non-birefringent, for reasons similar to those discussed above with regard to the bubble-suppressant layer. Suitable supports include polyethylene, polypropylene, polycarbonate, cellulose acetate, and polystyrene. The preferred material for the support is a polyester, desirably poly(ethylene terephthalate).

As explained in more detail in the aforementioned copending application Ser. No. 07/696,196, in some imaging media of the type described in the aforementioned patents, there is a tendency for one or more of the colored materials produced during imaging to diffuse out of their color-forming layers, but such undesirable diffusion of colored material can be reduced or eliminated by dispersing the leuco dye in a first polymer having a glass transition temperature of at least about 50° C., preferably at least about 75° C., and most preferably at least about 95° C., and providing a diffusion-reducing layer in contact with the color-forming layer, this diffusion-reducing layer comprising a second polymer having a glass transition temperature of at least about 50° C. and being essentially free from the color-forming composition. Desirably, the diffusion-reducing layer has a thickness of at least about 1 μm. The first polymer is desirably an acrylic polymer, preferably poly(methyl methacrylate). Although the relationship between glass transition temperature of the polymer used in the color-forming layer and bubble formation has not been extensively researched, during experiments conducted by the present inventors and their co-workers there have been some indications that the use a polymer having a glass transition temperature of at least about 50° C. may render the color-forming layer more susceptible to bubble formation. Hence, the use of a bubble-suppressant layer in accordance with the present invention may be especially useful when at least one color-forming layer has a glass transition temperature of at least about 50° C.

A preferred form of the imaging medium having a high glass transition temperature color-forming layer and a diffusion-reducing layer comprises:

a first color-forming layer superposed on the support;

a diffusion-reducing layer superposed on and in contact with the first color-forming layer;

a second color-forming layer superposed on the diffusion-reducing layer, the second color-forming layer comprising a second color-forming composition adapted to undergo a change of color upon increase in the temperature of the color-forming layer above a second color-forming temperature for a second color-forming time, the color change undergone by the second color-forming layer being different from that undergone by the other color-forming layer; and an interlayer interposed between the diffusion-reducing layer and the color-forming layer, the interlayer having a glass transition temperature less than about 50° C.

The color-forming composition used in the present imaging medium may be any of those described in the aforementioned patents and copending Applications. Thus, the color-forming composition may be:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound (see U.S. Pat. No. 4,602,263);

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored (see U.S. Pat. No. 4,720,449);

c. a colored di- or triarylmethane imaging compound possessing within its di- or triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triarylmethane compound becomes ring-closed and rendered colorless (see U.S. Pat. No. 4,720,450);

d. in combination, a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound (see U.S. Pat. No. 4,745,046);

e. a compound of the formula $$[M'\text{-}(X)_q]_p D$$

wherein M' has the formula:

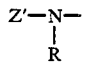

wherein R is alkyl; $-SO_2R^1$ wherein $R^1$ is alkyl; phenyl; naphthyl; or phenyl substituted with alkyl, alkoxy, halo, trifluoromethyl, cyano, nitro, carboxy, $-CONR^2R^3$ wherein $R^2$ and $R^3$ each are hydrogen or alkyl, $-CO_2R^4$ wherein $R^4$ is alkyl or phenyl, $-COR^5$ wherein $R^5$ is amino, alkyl or phenyl, $-NR^6R^7$ wherein $R^6$ and $R^7$ each are hydrogen or alkyl, $-SO_2NR^8R^9$ wherein $R^8$ and $R^9$ each are hydrogen, alkyl or benzyl; Z' has the formula:

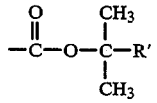

wherein R' is halomethyl or alkyl; X is —N=, $-SO_2-$ or $-CH_2-$; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye (see U.S. Pat. No. 4,826,976);

f. a substantially colorless di- or triarylmethane compound of the formula:

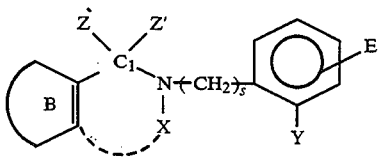

wherein ring B represents a carbocyclic aryl ring or a heterocyclic aryl ring; $C_1$ represents the meso carbon atom of said di- or triarylmethane compound; X represents —C(=O)—; $-SO_2-$ or $-CH_2-$ and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open (see U.S. Pat. No. 4,960,901);

g. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye;

h. a mixed carbonate ester of a quinophthalone dye and a tertiary alkanol containing not more than about 9 carbon atoms (see the aforementioned U.S. Pat. No. 5,243,052);

i. a leuco dye represented by:

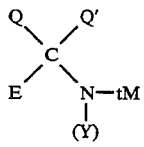

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

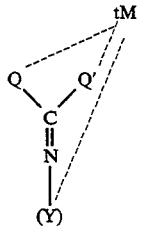

wherein said dotted lines indicate that said tM group is bonded to said Group 5A/Group 6A atom in one of said Q, Q' and (Y) (see the aforementioned U.S. Pat. No. 5,236,884). One especially preferred leuco dye is that of the formula:

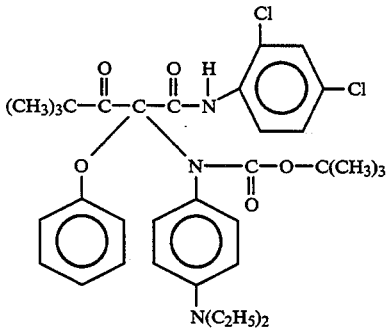

(hereinafter referred to as "Leuco Dye A").

Except for the presence of the bubble-suppressant layer, the other layers of the imaging medium of the present invention, and the techniques used for forming and exposing the medium, can be those used in the aforementioned U.S. Pat. Nos. 4,602,263; 4,720,449; 4,720,450; 4,745,046; 4,826,976; and 4,960,901, the disclosures of which are herein incorporated by reference. Thus, in carrying out the imaging method of the present invention, heat may be applied or induced imagewise in a variety of ways. Preferably, selective heating is produced in the color-forming layer itself by the conversion of electromagnetic radiation into heat, and preferably the light source is a laser emitting source such as a gas laser or semiconductor laser diode. The use of a laser beam is not only well suited for recording in a scanning mode but by utilizing a highly concentrated beam, radiant energy can be concentrated in a small area so that it is possible to record at high speed and high density. Also, it is a convenient way to record data as a heat pattern in response to transmitted signals, such as digitized information, and a convenient way of preparing multicolor images by employing a plurality of laser sources that emit at differing wavelengths.

Most of the aforementioned preferred leuco dyes do not absorb strongly in the infra-red. Since, at present, imaging processes are preferably carried out using an infra-red laser, in a preferred embodiment, the heat-sensitive element contains an infra-red absorbing substance for converting infra-red radiation into heat, which is transferred to the leuco dye to initiate the color-forming reaction and effect the change in the absorption characteristics of the leuco dye from colorless to colored. Obviously, the infra-red absorber should be in heat-conductive relationship with the leuco dye, for example, in the same layer as the leuco dye or in an adjacent layer. Though an inorganic compound may be employed, the infra-red absorber preferably is an organic compound, such as a cyanine, merocyanine, squarylium, thiopyrylium or benzpyrylium dye, and preferably, is substantially non-absorbing in the visible region of the electromagnetic spectrum so that it will not contribute any substantial amount of color to the $D_{min}$ areas, i.e., the highlight areas of the image. The light absorbed by the respective infra-red absorbers is converted into heat and the heat initiates the reaction to effect the formation of colored compounds in the color-forming layers.

In the production of such multi-color images, the infra-red absorbers are desirably selected such that they absorb radiation at different predetermined wavelengths above 700 nm sufficiently separated so that each color-forming layer may be exposed separately and independently of the others by using infra-red radiation at the particular wavelengths selectively absorbed by the respective infra-red absorbers. As an illustration, the color-forming layers containing yellow, magenta and cyan leuco dyes may have infra-red absorbers associated therewith that absorb radiation at 760 nm, 820 nm and 880 nm, respectively, and may be addressed by laser sources, for example, infra-red laser diodes emitting laser beams at these respective wavelengths so that the three color-forming layers can be exposed independently of one another. While each layer may be exposed in a separate scan, it is usually preferred to expose all of the color-forming layers simultaneously in a single scan using multiple laser sources of the appropriate wavelengths. Instead of using superimposed imaging layers, the leuco dyes and associated infra-red absorbers may be arranged in an array of side-by-side dots or stripes in a single recording layer.

Where imagewise heating is induced by converting light to heat as in the embodiments described above, the imaging medium may be heated prior to or during exposure. This may be achieved using a heating platen or heated drum or by employing an additional laser source or other appropriate means for heating the medium while it is being exposed.

The imaging medium of the present invention may comprise additional layers, for example, a subbing layer to improve adhesion to a support, interlayers for thermally insulating the color-forming layers from each other, an ultra-violet screening layer having an ultraviolet absorber therein, or other auxiliary layers. To give good protection against ultra-violet radiation, ultra-violet screening layers are desirably provided on both sides of the color-forming layer(s); conveniently, one of the ultra-violet screening layers is provided by using as the support a polymer film containing an ultra-violet absorber, and such absorber-containing films are available commercially. Some of these auxiliary layers (for example an anti-abrasion layer) may be superposed on the bubble-suppressant layer; it is not required that the support and the bubble-suppressant layer form the outer surfaces of the imaging medium provided that the color-forming layer(s) are sandwiched between the support and the bubble-suppressant layer.

The leuco dyes are selected to give the desired color or combination of colors, and for multicolor images, the compounds selected may comprise the subtractive primaries yellow, magenta and cyan or other combinations of colors, which combinations may additionally include black. The leuco dyes generally are selected to give the subtractive colors cyan, magenta and yellow, as commonly employed in photographic processes to provide full natural color.

Usually the or each color-forming layer contains a binder and is formed by combining the leuco dye, the infra-red absorber and the binder in a common solvent, applying a layer of the coating composition to the support and then drying. Rather than a solution coating, the layer may be applied as a dispersion or an emulsion. The coating composition also may contain dispersing agents, plasticizers, defoaming agents, hindered amine light stabilizers and coating aids. In forming the color-forming layer(s) and the interlayers or other layers, temperatures should be maintained below levels that will cause the color-forming reaction to occur rapidly so that the leuco dyes will not be prematurely colored or bleached.

Examples of binders that may be used include poly(-vinyl alcohol), poly(vinyl pyrrolidone), methyl cellulose, cellulose acetate butyrate, styrene-acrylonitrile copolymers, copolymers of styrene and butadiene, poly(methyl methacrylate), copolymers of methyl and ethyl acrylate, poly(vinyl acetate), poly(vinyl butyral), polyurethane, polycarbonate and poly(vinyl chloride). It will be appreciated that the binder selected should not have any adverse effect on the leuco dye incorporated therein and may be selected to have a beneficial effect. Also, the binder should be substantially heat-stable at the temperatures encountered during image formation and it should be transparent so that it does not interfere with viewing of the color image. Where electromagnetic radiation is employed to induce imagewise heating, the binder also should transmit the light intended to initiate image formation.

A preferred embodiment of the invention will now be described, though by way of illustration only, with reference to the accompanying drawing, which is a schematic cross-section through an imaging medium of the present invention. The thicknesses of the various layers shown in the drawing are not to scale.

The imaging medium (generally designated 10) shown in the drawing is intended for use in the production of transparencies and comprises a substantially transparent support 12 formed of 4 mil (101 μm) poly-(ethylene terephthalate) (PET) film incorporating an ultra-violet absorber. Appropriate PET films are readily available commercially, for example as P4C1A film from DuPont de Nemours., Wilmington, Del.

The imaging medium 10 also comprises a diffusion-reducing subcoat 14 approximately 1 μm thick formed from a 10:1 w/w mixture of a water-dispersible styrene acrylic polymer (Joncryl 538 sold by S. C. Johnson & Son, Inc., Racine Wis. 53403) and a water-soluble acrylic polymer (Carboset 526 sold by The B.F. Goodrich Co., Akron Ohio 44313). The presence of the minor proportion of water-soluble acrylic polymer reduces the tendency for the layer 14 to crack during the coating process. The diffusion-reducing subcoat 14, which has a glass transition temperature of approximately 55° C., and serves the function of a conventional subcoat, namely increasing the adhesion of the color-forming layer 16 (described in detail below) to the support 12. The subcoat 14 also serves to reduce or eliminate migration of colored material from the color-forming layer 16 after imaging; if a conventional subcoat were employed in place of the diffusion-reducing subcoat 14, diffusion of the colored material from the layer 16 into the subcoat after imaging might cause loss of sharpness of the image. The subcoat 14 is coated onto the support 12 from an aqueous medium containing the water-dispersible and water-soluble polymers.

A yellow color-forming layer 16 is in contact with the diffusion-reducing subcoat 14. This color-forming layer 16 is approximately 5 μm thick and comprises approximately 47.5 parts by weight of the aforementioned Leuco Dye A, 1.6 parts by weight of an infra-red absorber of the formula:

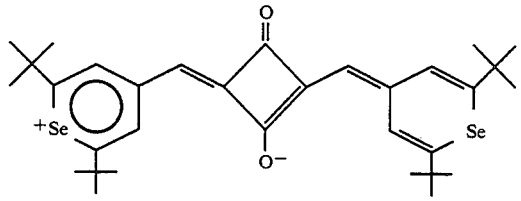

(which may be prepared by a process analogous to that described in U.S. Pat. No. 4,508,811 using the 2,6-bis(1,1-dimethylethyl)-4-methylselenopyrylium salts described in the aforementioned U.S. Pat. No. 5,231,190, 3.3 parts by weight of a hindered amine stabilizer (HALS-63, sold by Fairmount Chemical Co.), and 47.5 parts by weight of a poly(methyl methacrylate) binder (Elvacite 2021, sold by DuPont de Nemours, Wilmington, Del.; this material is stated by the manufacturer to be a methyl methacrylate/ethyl acrylate copolymer, but its glass transition temperature approximates that of poly(methyl methacrylate)). This binder has a glass transition temperature of approximately 110° C. The color-forming layer 16 is applied by coating from a mixture of heptanes and methyl ethyl ketone.

Superposed on the yellow color-forming layer 16 is a diffusion-reducing layer 18, which, like the first diffusion-reducing layer 14, serves to prevent migration of colored material from the yellow color-forming layer 16 on storage after imaging. The diffusion-reducing layer 18, which is approximately 2 μm thick, is formed of a water-dispersible styrene acrylic polymer (Joncryl 138 sold by S. C. Johnson & Son, Inc., Racine Wis. 53403), and is coated from an aqueous dispersion. This layer has a glass transition temperature of approximately 60° C.

The next layer of the imaging medium 10 is a solvent-resistant interlayer 20 approximately 4.6 μm and composed of a major proportion of partially cross-linked polyurethane (NeoRez XR-9637 polyurethane sold by ICI Resins US, Wilmington, Mass.) and a minor proportion of poly(vinyl alcohol) (Airvol 540, sold by Air Products and Chemicals, Inc., Allentown Pa. 18195). This solvent-resistant interlayer 20 is coated from an aqueous dispersion. The interlayer 20 not only helps to thermally insulate the color-forming layers 14 and 22 (described below) from one another during imaging, but also prevents disruption and/or damage to the yellow color-forming layer 16 and the diffusion-reducing layer 18 during coating of the magenta color-forming layer 22. Since the yellow color-forming layer 16 and the magenta color-forming layer 22 are both coated from organic solutions, if a solvent-resistant interlayer were not provided on the layer 16 before the layer 22 was coated, the organic solvent used to coat the layer 22 may disrupt, damage or extract leuco dye or infra-red absorber from the layer 16. Provision of the solvent-resistant interlayer 20, which is not dissolved by and does not swell in the organic solvent used to coat the layer 22, serves to prevent disruption of or damage to the layer 16 as the layer 22 is coated. Furthermore, the solvent-resistant interlayer 20 serves to prevent the magenta leuco dye, infra-red dye and hindered amine light stabilizer from the layer 22 sinking into the diffusion-reducing layer 18 and the yellow color-forming layer 16 as the layer 22 is being coated.

Superposed on the solvent-resistant interlayer 20 is the magenta color-forming layer 22, which is approximately 3 μm thick and comprises approximately 47.25 parts by weight of a leuco dye of the formula:

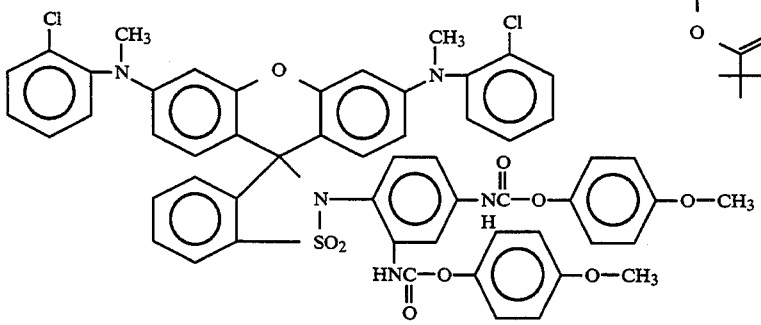

(hereinafter referred to as "Leuco Dye B"; this leuco dye may be prepared by the methods described in the aforementioned U.S. Pat. Nos. 4,720,449 and 4,960,901), 1.62 parts by weight of an infra-red absorber of the formula:

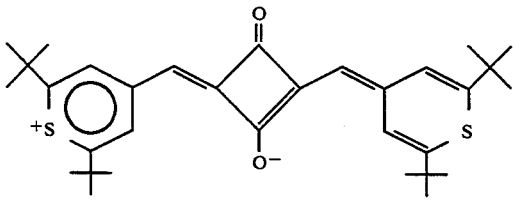

(see the aforementioned U.S. Pat. No. 4,508,811), 3.6 parts by weight of a hindered amine stabilizer (HALS-63), 0.27 parts by weight of a wetting agent, and 47.25 parts by weight of a polyurethane binder (Estane 5715, supplied by The B.F. Goodrich Co., Akron Ohio 44313). The color-forming layer 22 is applied by coating from a cyclohexanone/methyl ethyl ketone mixture.

On the color-forming layer 22 is coated a second solvent-resistant interlayer 24 which is formed from the same material, and coated in the same manner as, the solvent-resistant interlayer 20.

Superposed on the second solvent-resistant interlayer 24 is a cyan color-forming layer 26, which is approximately 3 μm thick and comprises approximately 49.5 parts by weight of a leuco dye of the formula:

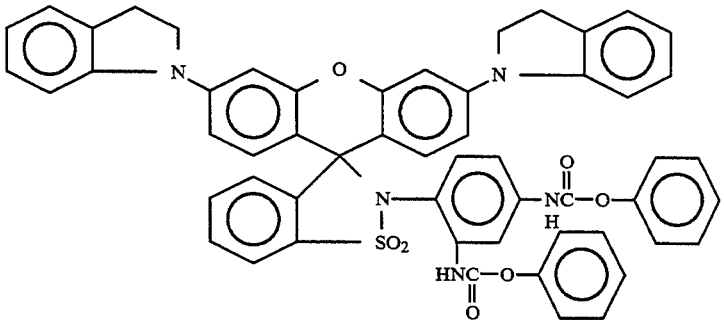

(hereinafter referred to as "Leuco Dye C"; this leuco dye may be prepared by the methods described in the aforementioned U.S. Pat. Nos. 4,720,449 and 4,960,901), 0.7 parts by weight of an infra-red absorber of the formula:

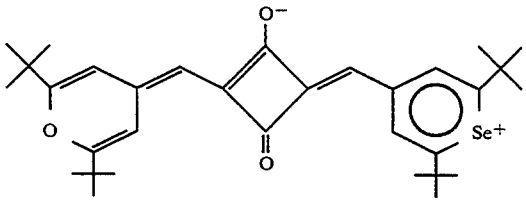

(which may be prepared as described in the aforementioned U.S. Pat. No. 5,231,190), 0.2 parts of a wetting agent, and 49.5 parts by weight of a polyurethane binder (Estane 5715). The color-forming layer 26 is applied by coating from methyl ethyl ketone.

As already indicated, the layers 14–26 of the imaging medium 10 are produced by coating on to the transparent support 12. However, the remaining layers of the imaging medium 10, namely the transparent bubble-suppressant layer 32, the ultraviolet filter layer 30 and the adhesive layer 28 are not coated on to the layer 26 but rather are prepared as a separate unit and then laminated to the remaining layers of the medium.

The transparent bubble-suppressant layer 32 is a 1.75 mil (44 μm) PET film, a preferred film being that sold as ICI 505 film by ICI Americas, Inc., Wilmington, Del. In accordance with the present invention, the bubble-suppressant layer 32 prevents the formation of bubbles in the color-forming layers 16, 22 and 26 of the imaging medium 10 during imaging, and thus helps to ensure that blackening of the image does not occur.

The ultraviolet filter layer 30 serves to protect the color-forming layers 16, 22 and 26 from the effects of ambient ultraviolet radiation. It has been found that the leuco dyes are susceptible to undergoing color changes when exposed to ultraviolet radiation during storage before or after imaging; such color changes are obviously undesirable since they increase the $D_{min}$ of the image and may distort the colors therein. The ultraviolet filter layer 30 is approximately 5 μm thick and comprises approximately 83 percent by weight of a poly(-methyl methacrylate) (Elvacite 2043, sold by DuPont de Nemours, Wilmington, Mass.), 16.6 percent by weight of an ultraviolet filter (Tinuvin 328 sold by Ciba-Geigy, Ardsdale N.Y.) and 0.4 percent by weight of a wetting agent. The ultraviolet filter layer 30 is prepared by coating on to the bubble-suppressant layer 32 from a solution in methyl ethyl ketone.

The adhesive layer, which is approximately 2 μm thick, is formed of a water-dispersible styrene acrylic polymer (Joncryl 138 sold by S. C. Johnson & Son, Inc., Racine Wis. 53403) and is coated on to the ultraviolet filter layer 30 from an aqueous dispersion.

After the layers 30 and 28 have been coated on to the bubble-suppressant layer 32, the entire structure containing these three layers is laminated under heat (approximately 225° F., 107° C.) and pressure to the structure containing the layers 12–26 to form the complete imaging medium 10.

If desired, the bubble-suppressant layer 32 may be formed by coating, rather than by lamination of a preformed film on to the layers 12–26. If the bubble-suppressant layer 32 is to be formed by coating, it is convenient to incorporate an ultra-violet absorber into the bubble-suppressant layer, thereby avoiding the need for a separate ultra-violet absorber layer. Thus, in this case, the layer 28 is coated on to the layer 26 using the solvent already described, and then the bubble-suppressant layer 32 containing the ultra-violet absorber may be coated on to the layer 28 from an aqueous medium.

The medium 10 is imaged by exposing it simultaneously to the beams from three infra-red lasers having wavelengths of approximately 792, 822 and 869 nm. The 869 nm beam images the yellow color-forming layer 16, the 822 nm beam images the magenta color-forming layer 22 and the 792 nm beam images the cyan color-forming layer 26. Thus, a multicolor image is formed in the imaging medium 10, and this multicolor image requires no further development steps. Furthermore, the medium 10 may be handled in normal room lighting prior to exposure, and the apparatus in which the imaging is performed need not be light-tight.

EXAMPLE

Three multicolor imaging media, differing only in that the bubble-suppressant layers were of varying thickness, and hereinafter referred to as media A, B and C, were prepared as follows.

The support 12 and the layers 14–26 were identical to those described in detail above with reference to the accompanying drawing. However, in these experimental media, a coated bubble-suppressant layer was substituted for the laminated bubble-suppressant layer 32 described above. To prepare this coated bubble-suppressant layer, there was coated on to layer 26, in place of adhesive layer 28, a diffusion barrier layer approximately 2 μm thick, formed of a water-dispersible styrene acrylic polymer (Joncryl 538 sold by S. C. Johnson and San, Inc., Racine Wis. 53403). On to this diffusion barrier layer was coated a bubble-suppressant layer containing an ultraviolet absorber; this bubble-suppressant layer thus served the functions of both the layers 30 and 32 described above. This bubble-suppressant layer comprised 89.5 percent by weight of a polyurethane (NeoRez R-966 sold by ICI Resins US, Wilmington, Mass.), 4.7 percent by weight of a non-ionic water-soluble poly(ethylene oxide) (Polyox N-3000, sold by Union Carbide Corporation, Danbury, Conn.), 4 percent by weight of an ultraviolet filter (Tinuvin 1130 sold by sold by Ciba-Geigy, Ardsdale N.Y.) and 1.8 percent by weight of a wax lubricant (Michemlube 160 sold by Michaelman Chemical Corporation), and was coated from an aqueous dispersion. The bubble-suppressant layer was coated at coating weights of approximately 2000, 1500 and 1000 mg/ft$^2$, respectively, for media A, B and C. The dried thicknesses of the resultant bubble-suppressant layers in media A, B and C were measured by microscopy of cross-sections of the media and found to be, respectively, 19 microns, 14.5 microns and 10 microns.

Each medium was imaged by exposure to radiation from three GaAlAs diode lasers emitting at wavelengths of 792, 822 and 869 nm and delivering 151, 127 and 62 mW, respectively, to the medium. The 792 nm beam imaged the cyan color-forming layer 26, the 822 nm laser imaged the magenta color-forming layer 22 and the 869 nm laser imaged the yellow color-forming layer 16. A given area of the medium was exposed only at one laser wavelength. The media were wrapped around a drum whose axis was perpendicular to the incident laser beam, such that exposure took place through the bubble-suppressant layer. The laser outputs were focussed to spots of approximately 33×3 μm in size on the medium. Rotation of the drum about its axis and simultaneous translation in the direction of the axis caused the laser spot to write a helical pattern on the medium. The pitch of the helix was 33 microns, so that none of the medium was left unexposed between adjacent scans. In this arrangement, the exposure received by the medium was inversely proportional to the speed of rotation of the drum (measured as a linear speed at the medium surface, referred to as "scanning speed"). After exposure, the optical density (OD) in transmission of the exposed region of the medium was measured in the red, green or blue region of the electromagnetic spectrum, as appropriate, using an X-Rite 310 photographic densitometer (supplied by X-Rite, Inc., Grandville, Mich.) with the appropriate filter. Where light scattering due to bubble formation was evident by examination of the medium in transmitted light (and confirmed by microscopic examination of the medium) a density reading was not obtained.

The results of the experiments described above are summarized in the Table below. Each measurement is an average of three readings taken on differing parts of the exposed medium.

TABLE

| | Exposure at 792 nm | | |
|---|---|---|---|
| Scanning Speed (m/s) | OD (red), Medium A | OD (red), Medium B | OD (red), Medium C |
| 0.18 | 3.15 | Bubbles | Bubbles |
| 0.21 | 2.42 | 2.45 | Bubbles |
| 0.25 | 1.22 | 1.20 | 0.97 |

Exposure at 822 nm

TABLE-continued

| Scanning Speed (m/s) | OD (green), Medium A | OD (green), Medium B | OD (green), Medium C |
|---|---|---|---|
| 0.25 | 3.63 | Bubbles | Bubbles |
| 0.36 | 2.50 | 1.47 | 1.59 |
| 0.50 | 1.06 | 0.52 | 0.66 |
| | Exposure at 869 nm | | |
| Scanning Speed (m/s) | OD (blue), Medium A | OD (blue), Medium B | OD (blue), Medium C |
| 0.14 | 2.50 | 2.61 | 2.47 |
| 0.16 | 2.04 | 2.03 | 1.87 |
| 0.18 | 1.48 | 1.59 | 1.51 |

From the data in the Table, it will be seen that suppression of bubble formation in all three color-forming layers was only achieved in medium A, in which the bubble-suppressant layer has a thickness 19 microns. Media B and C, in which the bubble-suppressant layer had a thickness of 10 microns, exhibited bubble formation in both the cyan color-forming layer 26 and the magenta color-forming layer 22.

It will be appreciated that the imaging conditions used in these experiments were severe, in that the scanning speeds employed were relatively low and the media were exposed to relatively high optical densities. Under other scanning conditions, the thinner bubble-suppressant layers in media A and B would be effective to prevent bubble formation.

From the foregoing, it will be seen that the provision of a bubble-suppressant layer in accordance with the present invention is effective in preventing bubble formation in the color-forming layers of the imaging medium, and hence permits one to obtain images which do not suffer from blackening. The bubble-suppressant layer also serves to protect the color-forming layers before or after imaging, and to prevent leuco dye, colored products or other components of the imaging medium from escaping from the medium during imaging, thus preventing contamination of the apparatus in which the imaging is being effected.

We claim:

1. An imaging medium capable of being imaged to form a transparency and comprising:

a substantially transparent support having a thickness of at least about 20 μm;

a color-forming layer superposed on the support and adapted to undergo a change of color upon increase in the temperature of the color-forming layer above a color-forming temperature for a color-forming time, the color-forming layer comprising a color-forming compound which undergoes a change of color upon heating above the color-forming temperature for the color-forming time, and an absorber capable of absorbing actinic radiation and thereby generating heat in the color-forming layer; and a bubble-suppressant layer superposed on the color-forming layer and having a thickness of at least about 10 μm, such that, upon imagewise exposure of the imaging medium to actinic radiation absorbed by the absorber and consequent imagewise increase in the temperature of the color-forming compound above the color-forming temperature for the color-forming time, in heated regions the color-forming compound undergoes its change of color but the color-forming layer remains essentially free from bubbles.

2. An imaging medium according to claim 1 in which the bubble-suppressant layer has a thickness in the range of about 15 μm to about 100 μm.

3. An imaging medium according to claim 1 in which the bubble-suppressant layer has a thickness of at least about 20 μm.

4. An imaging medium according to claim 1 wherein the bubble-suppressant layer comprises a polyester.

5. An imaging medium according to claim 4 wherein the bubble-suppressant layer comprises poly(ethylene terephthalate).

6. An imaging medium according to claim 5 wherein the support has a thickness of at least about 50 μm.

7. An imaging medium according to claim 1 wherein the support comprises a polyester.

8. An imaging medium according to claim 1 in which the color-forming compound is selected from the group consisting of:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound;

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored;

c. a colored di- or triarylmethane imaging compound possessing within its dior triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triaryimethane compound becomes ring-closed and rendered colorless;

d. a compound of the formula $$[M'(X)_q]_p D$$

wherein M' has the formula:

$$Z'-\underset{\underset{R}{|}}{N}-$$

wherein R is alkyl; $-SO_2R^1$ wherein $R^1$ is alkyl; phenyl; naphthyl; or phenyl substituted with alkyl, alkoxy, halo, trifluoromethyl, cyano, nitro, carboxy, —$CONR^2R^3$ wherein $R^2$ and $R^3$ each are hydrogen or alkyl, —$CO_2R^4$ wherein $R^4$ is alkyl or phenyl, —$COR^5$ wherein $R^5$ is amino, alkyl or phenyl, —$NR^6R^7$ wherein $R^6$ and $R^7$ each are hydrogen or alkyl, —$SO_2NR^9$ wherein $R^8$ and $R^9$ each are hydrogen, alkyl or benzyl; Z' has the formula:

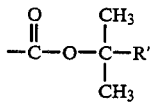

wherein R' is halomethyl or alkyl; X is —N=, —$SO_2$— or —$CH_2$—; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye;

e. a substantially colorless di- or triarylmethane compound of the formula:

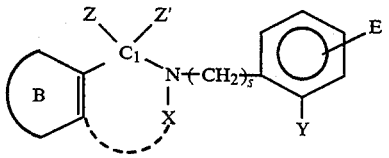

wherein ring B represents a carbocyclic aryl ring or a heterocyclic aryl ring; $C_1$ represents the meso carbon atom of said di- or triarylmethane compound; X represents —C(=O)—; —$SO_2$— or —$CH_2$— and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open;

f. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye;

g. mixed carbonate ester of a quinophthalone dye and a tertiary alkanol containing not more than about 9 carbon atoms h. a leuco dye represented by:

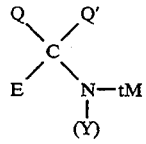

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

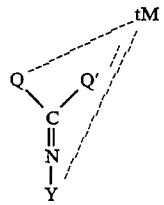

wherein said dotted lines indicate that said tM group is bonded to said Group 5A/Group 6A atom in one of said Q, Q' and (Y).

9. An imaging medium according to claim 8 in which the color-forming component comprises

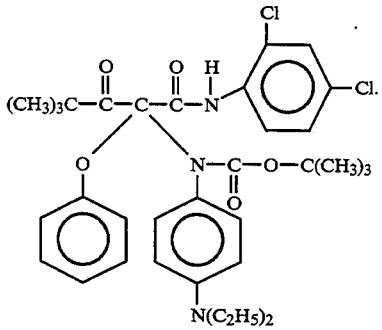

10. An imaging medium according to claim 1 wherein the color-forming compound undergoes an irreversible change of color upon heating above the color-forming temperature for the color-forming time.

11. An imaging medium capable of being imaged to form a transparency and comprising:

a substantially transparent support having a thickness of at least about 20 μm;

a color-forming layer superposed on the support and adapted to undergo a change of color upon increase in the temperature of the color-forming layer above a color-forming temperature for color-forming time, the color-forming layer comprising a color-forming compound which undergoes change of color upon heating above the color-forming temperature for the color-forming time, and an absorber capable of absorbing actinic radiation and thereby generating heat in the color-forming layer; and a bubble-suppressant layer superposed on the color-forming layer and having thickness of at least about 10 μm, such that, upon imagewise exposure of the imaging medium to actinic radiation absorbed by the absorber and consequent imagewise increase in the temperature of the color-forming compound above the color-forming temperature for the color-forming time, in heated regions the color-forming compound undergoes its change of color but the color-forming layer remains essentially free from bubbles, in which medium the color-forming layer comprises a polymer and has a glass transition temperature of at least 50° C., the imaging medium further comprising a diffusion-reducing layer in contact with one face of the color-forming layer, the diffusion-reducing layer comprising a second polymer, having a glass transition temperature of at least about 50° C., and being essentially free from the color-forming compound and the absorber.

12. An imaging medium according to claim 4 in which the color-forming layer has a glass transition temperature of at least 75° C.

13. An imaging medium according to claim 11 in which the polymer in the color-forming layer is an acrylic polymer.

14. An imaging medium according to claim 13 in which the polymer in the color-forming layer comprises poly(methyl methacrylate).

15. An imaging medium according to claim 14 in which the diffusion-reducing layer has a thickness of at least about 1 μm.

16. An imaging medium according to claim 11 wherein the diffusion-reducing layer is in contact with the face of the color-forming layer remote from the support, and the imaging medium further comprises:

a second color-forming layer superposed on the diffusion-reducing layer, the second color-forming layer being adapted to undergo a change of color upon increase in the temperature of the second color-forming layer above a second color-forming temperature for a second color-forming time, the color change undergone by the second color-forming layer being different from that undergone by the other color-forming layer, the second color-forming composition comprising a second color-forming compound which undergoes a change of color upon heating above the second color-forming temperature for the second color-forming time, and a second absorber capable of absorbing actinic radiation and thereby generating heat in the color-forming layer, the second absorber being capable of absorbing radiation of a wavelength different from that absorbed by the absorber in the other color-forming layer; and an interlayer interposed between the diffusion-reducing layer and the second color-forming layer, the interlayer having a glass transition temperature less than about 50° C., the bubble-suppressant layer being superposed on the second color-forming layer so that the two color-forming layers, the diffusion-reducing layer and the interlayer all lie between the support and the bubble-suppressant layer.

17. A process for forming an image, the process comprising:

providing an imaging medium comprising a substantially transparent support having a thickness of at least about 20 μm; a color-forming layer superposed on the support and adapted to undergo a change of color upon increase in the temperature of the color-forming layer above a color-forming temperature for a color-forming time, the color-forming layer comprising a color-forming compound which undergoes a change of color upon heating above the color-forming temperature for the color-forming time, and an absorber capable of absorbing actinic radiation and thereby generating heat in the color-forming layer; and a bubble-suppressant layer superposed on the color-forming layer and having a thickness of at least about 10 μm; and imagewise exposing the imaging medium to actinic radiation absorbed by the absorber, thereby causing imagewise absorption of the actinic radiation by the absorber and imagewise heating of the color-forming compound above the color-forming temperature for the color-forming time, thereby causing the color-forming compound to undergo the change of color in heated regions and thereby form an image, the color-forming layer being essentially free from bubbles after the imagewise heating.

18. A process according to claim 17 in which the bubble-suppressant layer has a thickness in the range of about 15 μm to about 100 μm.

19. A process according to claim 17 in which the bubble-suppressant layer has a thickness of at least about 20 μm.

20. A process according to claim 17 in which the color-forming compound is selected from the group consisting of:

a. an organic compound capable of undergoing, upon heating, an irreversible unimolecular fragmentation of at least one thermally unstable carbamate moiety, this organic compound initially absorbing radiation in the visible or the non-visible region of the electromagnetic spectrum, said unimolecular fragmentation visibly changing the appearance of the organic compound;

b. a substantially colorless di- or triarylmethane imaging compound possessing within its di- or triarylmethane structure an aryl group substituted in the ortho position to the meso carbon atom with a moiety ring-closed on the meso carbon atom to form a 5- or 6-membered ring, said moiety possessing a nitrogen atom bonded directly to said meso carbon atom and said nitrogen atom being bound to a group with a masked acyl substituent that undergoes fragmentation upon heating to liberate the acyl group for effecting intramolecular acylation of said nitrogen atom to form a new group in the ortho position that cannot bond to the meso carbon atom, whereby said di- or triarylmethane compound is rendered colored;

c. a colored di- or triarylmethane imaging compound possessing within its di- or triarylmethane structure an aryl group substituted in the ortho position to the meso carbon atom with a thermally unstable urea moiety, said urea moiety undergoing a unimolecular fragmentation reaction upon heating to provide a new group in said ortho position that bonds to said meso carbon atom to form a ring having 5 or 6 members, whereby said di- or triarylmethane compound becomes ring-closed and rendered colorless;

d. a compound of the formula $$[M'\text{-}(X)_q]_p D$$

wherein M' has the formula:

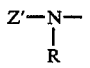

wherein R is alkyl; $—SO_2R^1$ wherein $R^1$ is alkyl; phenyl; naphthyl; or phenyl substituted with alkyl, alkoxy, halo, trifluoromethyl, cyano, nitro, carboxy, $—CONR^2R^3$ wherein $R^2$ and $R^3$ each are hydrogen or alkyl, $—CO_2R^4$ wherein $R^4$ is alkyl or phenyl, $—COR^5$ wherein $R^5$ is amino, alkyl or phenyl, $—NR^6R^7$ wherein $R^6$ and $R^7$ each are hydrogen or alkyl, $—SO_2NR^8R^9$ wherein $R^8$ and $R^9$ each are hydrogen, alkyl or benzyl; Z' has the formula:

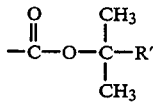

wherein R' is halomethyl or alkyl; X is —N=, $—SO_2—$ or $—CH_2—$; D taken with X and M' represents the radical of a color-shifted organic dye; q is 0 or 1; and p is a whole number of at least 1; said Z' being removed from said M' upon the application of heat to effect a visually discernible change in spectral absorption characteristics of said dye;

e. a substantially colorless di- or triarylmethane compound of the formula:

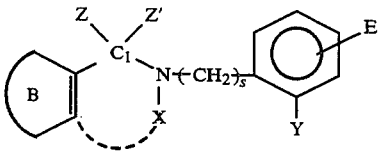

wherein ring B represents a carbocyclic aryl ring or a heterocyclic aryl ring; $C_1$ represents the meso carbon atom of said di- or triarylmethane compound; X represents —C(=O)—; $—SO_2—$ or $—CH_2—$ and completes a moiety ring-closed on said meso carbon atom, said moiety including the nitrogen atom bonded directly to said meso carbon atom; Y represents —NH—C(=O)—L, wherein L is a leaving group that departs upon thermal fragmentation to unmask —N=C=O for effecting intramolecular acylation of said nitrogen atom to open the N-containing ring and form a new group in the ortho position of ring B that cannot bond to said meso carbon atom; E is hydrogen, an electron-donating group, an electron-withdrawing group or a group, either an electron-donating group or an electron-neutral group that undergoes fragmentation upon heating to liberate an electron-withdrawing group; s is 0 or 1; and Z and Z' taken individually represent the moieties to complete the auxochromic system of a diarylmethane or triarylmethane dye when said N-containing ring is open, and Z and Z' taken together represent the bridged moieties to complete the auxochromic system of a bridged triarylmethane dye when said N-containing ring is open;

f. a colorless precursor of a preformed image dye substituted with (a) at least one thermally removable protecting group that undergoes fragmentation from said precursor upon heating and (b) at least one leaving group that is irreversibly eliminated from said precursor upon heating, provided that neither said protecting group nor said leaving group is hydrogen, said protecting and leaving groups maintaining said precursor in its colorless form until heat is applied to effect removal of said protecting and leaving groups whereby said colorless precursor is converted to an image dye;

g. mixed carbonate ester of a quinophthalone dye and a tertiary alkanol containing not more than about 9 carbon atoms h. a leuco dye represented by:

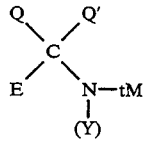

wherein:

E represents a thermally removable leaving group;

tM represents a thermally migratable acyl group;

Q, Q' and C taken together represent a dye-forming coupler moiety wherein C is the coupling carbon of said coupler moiety;

and, (Y) taken together with N represents an aromatic amino color developer, one of said Q, Q' and (Y) containing an atom selected from the atoms comprising Group 5A/Group 6A of the Periodic Table, said groups E and tM maintaining said leuco dye in a substantially colorless form until the application of heat causes said group E to be eliminated from said leuco dye and said group tM to migrate from said N atom to said Group 5A/Group 6A atom thereby forming a dye represented by:

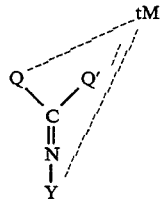

wherein said dotted lines indicate that said tM group is bonded to said Group 5A/Group 6A atom in one of said Q, Q' and (Y).

21. A process according to claim 20 in which the color-forming compound comprises

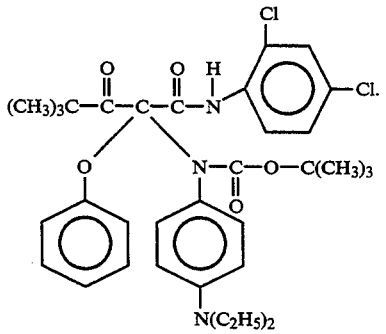

22. A process according to claim 17 wherein the color-forming compound undergoes an irreversible change of color upon heating above the color-forming temperature for the color-forming time.

23. A process for forming an image, the process comprising:

providing an imaging medium comprising a substantially transparent support having a thickness of at least about 20 μm; a color-forming layer superposed on the support and adapted to undergo a change of color upon increase in the temperature of the color-forming layer above a color-forming temperature for a color-forming time, the color-forming layer comprising a color-forming compound which undergoes a change of color upon heating above the color-forming temperature for the color-forming time, and an absorber capable of absorbing actinic radiation and thereby generating heat in the color-forming layer; and a bubble-suppressant layer superposed on the color-forming layer and having a thickness of at least about 10 μm; and imagewise exposing the imaging medium to actinic radiation absorbed by the absorber, thereby causing imagewise absorption of the actinic radiation by the absorber and imagewise heating of the color-forming compound above the color-forming temperature for the color-forming time, thereby causing the color-forming compound to undergo the change of color in heated regions and thereby form an image, the color-forming layer being essentially free from bubbles after the imagewise heating, in which process the color-forming layer comprises a polymer and has a glass transition temperature of at least 50° C., and in which the imaging medium further comprises at least one diffusion-reducing layer in contact with one face of the color-forming layer, the or each diffusion-reducing layer comprising a second polymer, having a glass transition temperature of at least about 50° C., and being essentially free from the color-forming compound and the absorber, such that upon imagewise heating of the color-forming layer above the color-forming temperature for the color-forming time with consequent change in color of the color-forming compound in heated regions, production of a colored material in these heated regions, and formation of an image, and subsequent storage of the image for a period of at least about one week, no substantial movement of the colored material beyond the color-forming layer and the diffusion-reducing layer occurs.

24. An imaging medium capable of being imaged to form a transparency and comprising:

a substantially transparent support having a thickness of at least about 20 μm;

a color-forming layer superposed on the support and adapted to undergo a change of color upon increase in the temperature of the color-forming layer above a color-forming temperature for a color-forming time, the color-forming layer comprising a color-forming component which undergoes a change of color upon heating above the color-forming temperature for the color-forming time, and an absorber capable of absorbing actinic radiation and thereby generating heat in the color-forming layer, said color-forming component comprising a combination of a substantially colorless di- or triarylmethane compound possessing on the meso carbon atom within its di- or triarylmethane structure an aryl group substituted in the ortho position with a nucleophilic moiety which is ting-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound; and a bubble-suppressant layer superposed on the color-forming layer and having a thickness of at least about 10 μm, such that, upon imagewise exposure of the imaging medium to actinic radiation absorbed by the absorber and consequent imagewise increase in the temperature of the color-forming component above the color-forming temperature for the color-forming time, in heated regions the color-forming component undergoes its change of color but the color-forming layer remains essentially free from bubbles.

25. A process for forming an image, the process comprising:

providing an imaging medium comprising a substantially transparent support having a thickness of at least about 20 μm; a color-forming layer superposed on the support and adapted to undergo a change of color upon increase in the temperature of the color-forming layer above a color-forming temperature for a color-forming time, the color-forming layer comprising a color-forming component which undergoes a change of color upon heating above the color-forming temperature for the color-forming time, and an absorber capable of absorbing actinic radiation and thereby generating heat in the color-forming layer, said color-forming component comprising a combination of a substantially colorless di- or triarylmethane compound possessing on the meso carbon atom within its di- or triarylmethane structure an aryl group substituted in the ortho position with a nucleophilic moiety which is ring-closed on the meso carbon atom, and an electrophilic reagent which upon heating and contacting said di- or triarylmethane compound undergoes a bimolecular nucleophilic substitution reaction with said nucleophilic moiety to form a colored, ring-opened di- or triarylmethane compound; and a bubble-suppressant layer superposed on the color-forming layer and having a thickness of at least about 10 μm; and imagewise exposing the imaging medium to actinic radiation absorbed by the absorber, thereby causing imagewise absorption of the actinic radiation by the absorber and imagewise heating of the color-forming component above the color-forming temperature for the color-forming time, thereby causing the color-forming component to undergo the change of color in heated regions and thereby form an image, the color-forming layer being essentially free from bubbles after the imagewise heating.-

* * * * *